United States Patent [19]

Fuchs, Jr.

[11] Patent Number: 4,942,751

[45] Date of Patent: Jul. 24, 1990

[54] PROCESS AND APPARATUS FOR FORMING INTERNALLY ENHANCED TUBING

[75] Inventor: Francis J. Fuchs, Jr., Naples, Fla.

[73] Assignee: R. Gale Rhodes, Jr., Rumson, N.J. ; a part interest

[21] Appl. No.: 422,984

[22] Filed: Oct. 13, 1989

[51] Int. Cl.[5] ..... B21C 37/20

[52] U.S. Cl. ..... 72/68; 72/77; 72/283

[58] Field of Search ..... 72/68, 77, 78, 96, 75, 72/114, 283, 208; 29/157.3 AH

[56] References Cited

U.S. PATENT DOCUMENTS

| | | | |
|---|---|---|---|
| 2,645,954 | 7/1953 | Pfingston | 72/118 |
| 2,852,835 | 9/1958 | Harvey et al. | 72/283 |
| 3,118,328 | 1/1964 | Issott | 72/208 |

FOREIGN PATENT DOCUMENTS

| | | | |
|---|---|---|---|
| 15015 | 1/1985 | Japan | 72/68 |
| 115612 | 5/1988 | Japan | 72/68 |

*Primary Examiner*—Lowell A. Larson
*Attorney, Agent, or Firm*—R. Gale Rhodes, Jr.

[57] ABSTRACT

Process of providing the internal portion of tubing with at least one spiral fin, comprising the steps of: providing a first spinner having at least two first external spiral ridges displaced a predetermined distance angularly with respect to each other and providing a first spiral groove therebetween having a first depth and providing a first spiral path; producing relative motion between the first spinner and the tubing internal portion to cause the first external spiral ridges to engage the tubing internal portion and form spiral grooves therein and to cause a portion of the tubing internal portion to flow into the first spiral groove and form a spiral fin; providing a second spinner having at least two second external spiral ridges displaced the predetermined distance angularly with respect to each other and providing a second spiral groove therebetween having a second depth greater than the first depth and providing a second spiral path; and aligning the second external spiral ridges of the second spinner with the spiral grooves formed in the tubing internal portion by the first spinner and producing relative movement between the tubing and the second spinner to cause the second external spiral ridges to compress the spiral fin and to cause the spiral fin to flow into the second spiral groove and thereby increase the height of the spiral fin.

10 Claims, 4 Drawing Sheets

PROCESS AND APPARATUS FOR FORMING INTERNALLY ENHANCED TUBING

BACKGROUND OF THE INVENTION

The present invention is related to improved processes and apparatus for forming internally enhanced tubing sometimes referred to in the art as internally grooved tubing, grooved tube, internally finned tube or tubing, and tubing provided with at least one internal spiral fin and the like.

As known to those skilled in the art, such internally enhanced tubing when used in heat exchanger applications is more advantageous than internally smooth tube because the internal spiral fins of the internally enhanced tubing provide greater thermal transfer between the tubing and heat transfer fluid flowing therethrough such as, for example, air conditioning fluid. As is further known, generally, the greater the height of the internal spiral fin, the greater the thermal transfer.

More particularly, the present invention is an improvement in the process and apparatus for forming spiral fins on the internal portion of relatively thin wall tubing which, as known to those skilled in the art, is notoriously difficult to do without rupturing, tearing, or shearing of the thin tubing wall or, if done by prior art processes and apparatus successfully, is notoriously slow and thus unwantedly expensive.

Further, the present invention is an improvement of the process and apparatus disclosed in U.S. Pat. No. 4,702,906, patented Oct. 27, 1987, entitled APPARATUS AND PROCESS FOR PROVIDING TUBING WITH AT LEAST ONE INTERNAL SPIRAL GROOVE OR FIN, Francis J. Fuchs, Jr. inventor (referred to hereinafter as the "Fuchs '096 Patent"). While the process and apparatus of the Fuchs '096 Patent have successfully formed spiral fins on the internal portion of thin wall tubing of certain heights, there still exists a need for improved processes and apparatus for forming such spiral fins of even greater heights.

Various processes and apparatus of forming internally enhanced tubing, other than that disclosed in the Fuchs '096 Patent, are also known to the art, for example, the process sometimes referred to as ring rolling, shear spinning, and the like, wherein tubing is placed over a forming member such as a mandrel or roller provided with external spiral ridges providing spiral grooves therebetween and external rollers are rolled over and around the tubing to deform or indent the internal portion of the tubing into the underlying spiral grooves provided in the forming member to produce the internal spiral fins.

While the above-noted prior art ring rolling, etc., process and equipment generally produce internally enhanced tubing having internal spiral fins of the desired height, such prior art equipment is relatively unwantedly expensive and the process practiced by such equipment is notoriously slow which adds further unwanted expense.

Accordingly, there exists a need in the art for less expensive equipment and an improved and less expensive process for forming internally enhanced tubing having internal spiral fins of sufficient height to provide the above-noted desired greater thermal transfer.

SUMMARY OF THE INVENTION

Process satisfying the foregoing need in the art and embodying the present invention may include the steps of: providing a first spinner having at least two first external spiral ridges displaced a predetermined distance angularly with respect to each other and providing a first spiral groove therebetween having a first depth and providing a first spiral path; producing relative motion between the first spinner and the tubing internal portion to cause the first external spiral ridges to engage the tubing internal portion and form spiral grooves therein and to cause a portion of the tubing internal portion to flow into the first spiral groove and through the first spiral path and form a spiral fin; providing a second spinner having at least two second external spiral ridges displaced the predetermined distance angularly with respect to each other and providing a second spiral groove therebetween having a second depth greater than the first depth and providing a second spiral path; and aligning the second external spiral ridges of the second spinner with the spiral grooves formed in the tubing internal portion by the first spinner and producing relative movement between the tubing and the second spinner to cause the second external spiral ridges to compress the spiral fin and to cause the spiral fin to flow into the second spiral groove and through the second spiral path and thereby increase the height of the spiral fin without further reducing of the tubing wall thickness.

Spinner apparatus embodying the invention is provided with external spiral ridges providing spiral grooves therebetween which spiral grooves provide spiral paths through which spiral internal fins of tubing flow to cause the fins to increase in height without decreasing the wall thickness of the tubing; the spiral grooves decrease in width in the direction of the spiral paths.

The process of the present invention is an improvement over the process of the Fuchs '096 Patent in that it is a multi-stage process enabling the forming of internal fins of even greater height without rupture, tearing or shearing of the tubing wall.

DESCRIPTION OF THE DRAWINGS

FIGS. 6 and 7 show the tubing and a first spinner for producing spiral fins or arcuate sections from the tubing internal portion.

DESCRIPTION OF THE PREFERRED EMBODIMENTS

Recalling from the description of the drawings above that the structures shown in FIGS. 2–9 are partial transverse cross-sectional views of tubing and spinners, it will be understood that in the following detailed description of the invention the structures of the tubing and spinners will be set forth as if the entire structures were shown in order to provide a complete understanding of the structures.

Figure 1:
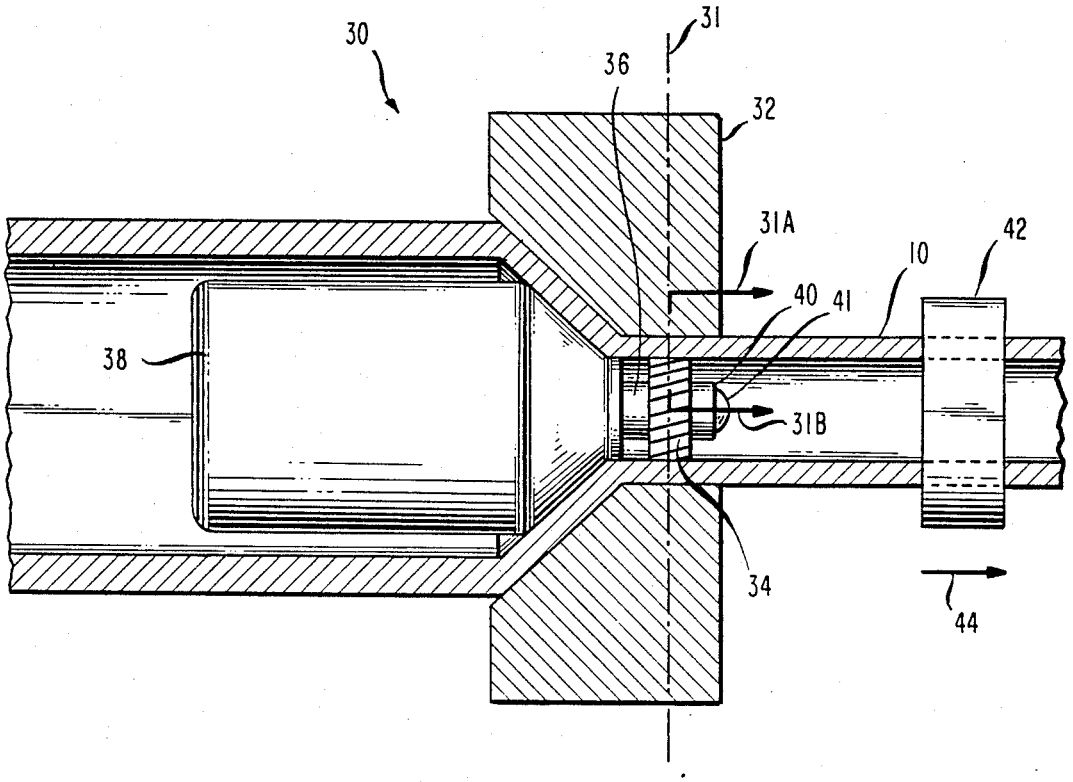
FIG. 1 is substantially FIG. 4 taken from the Fuchs '096 Patent but including a section line or transverse section plane 31 taken through the annular draw die 32, cylindrical tubing 10, annular spinner 34 and shaft 36 of the floating plug or mandrel 38; the annular draw die 32 has a passageway therethrough the forward portion of which is conical and the rearward portion of which is straight walled, the forward portion of the mandrel or floating plug 38 is conical. It will be understood that the processes of the present invention for forming internally enhanced tubing illustrated respectively in FIGS. 2–5 and FIGS. 6–9 are partial transverse cross-sectional views taken generally in the direction of the arrows 31A and 31B in FIG. 2 and generally of the portion of the transverse cross-sectional plane 31 indicated by the arrows 31A and 31B; for clarity of presentation in FIGS. 2–5 and FIGS. 6–9, the outer draw die 32 and shaft 36 have been eliminated. It will be further understood that since the tubing and respective spinners shown in FIGS. 2–5 and FIG. 6–9 are circular in transverse cross-section, the partial showings in FIGS. 2–5 and 6–9 of the tubing and spinners shown therein are representative of the entire tubing and spinners.
Figure 2:
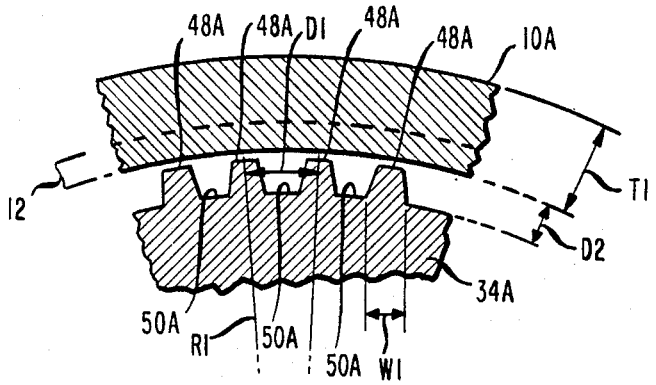
FIGS. 2 and 3 are such above-noted partial transverse cross-sectional views illustrating a first stage of one embodiment of a process of the present invention of providing the internal portion of tubing with spiral fins and illustrate the tubing and a first spinner for forming spiral fins in the internal portion of the tubing.

Reference is now made to the first process embodiment of the present invention for forming internally enhanced tubing, i.e. providing the internal portion of tubing with spiral fins; such process is illustrated in FIGS. 2–5 when taken in conjunction with FIG. 1. Referring first to FIG. 2, tubing 10A is shown having an original wall thickness T1 and including an internal portion 12 into which spiral fins are to be formed. A first spinner 34A is shown which, it will be understood, is of generally annular shape and provided around its cylindrical outer surface with a plurality of radially outwardly extending external spiral ridges 48A and a centrally formed aperture (not shown) for mounting the spinner 34A rotatably, for example, on the shaft 36 of the internal forming member or floating plug 38 shown in FIG. 1; the forward portion of the internal forming member or floating plug 38 is conical as shown in FIG. 1 and is positioned opposite and spaced from the conical forward portion of the passageway extending through the draw die 32. The spinner 34A has a radius R1 and the external spiral ridges 48A are displaced a distance D1 angularly with respect to each other and provide spiral grooves 50A therebetween having a depth D2 and which spiral grooves, it will be understood, provide spiral paths therethrough. The external spiral ridges 48A of the spinner 34A, as shown in FIG. 2, have a base width W1.

Figure 3:
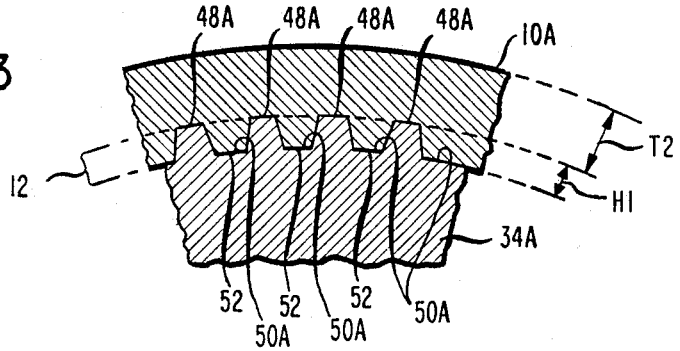

Referring now to FIGS. 1, 2 and 3, and to the first stage of the first process embodiment of the present invention, it will be presumed that the tubing 10A and spinner 34A from FIG. 2 occupy the positions shown in FIG. 1 for tubing 10 and spinner 34 and that the draw blocks 42 (FIG. 1) are engaging the tubing 10A and applying force thereto to move or advance the tubing 10A in the forward direction indicated by the arrow 44. Upon such movement, the tubing will be advanced between the opposed conical portions of the draw die 32 and floating plug 38 to reduce the outer diameter of the tubing 10A, approximately 15% in one embodiment (this reduction in outer diameter maintains the floating plug 38 in place), whereafter the tubing is advanced between the straight walled rearward portion of the passageway extending through the draw die 32 and the spinner 34A to cause the internal portion 12 of the tubing 10A (FIGS. 2 and 3) to engage the external spiral ridges 48A of the spinner 34A and impart rotation to the spinner and to cause the external spiral ridges 48A of the spinner 34A to engage the tubing internal portion 12 and from grooves therein and cause the tubing internal portion 12 to flow into the spiral grooves 50A (FIG. 2 and 3) and through the spiral paths provided by the grooves 50A and form the plurality of spiral fins 52 shown in FIG. 3 having a height H1; it will be understood by reference to FIG. 3 that in this first stage of forming the spiral fins 52 the original wall thickness T1 of the tubing 10A is reduced to a wall thickness T2. This first stage of the process continues until the internal portion 12 of the tubing 10A is provided along its internal length with the plurality of internal spiral fins 52 whereupon the tubing 10A, for example, may be wound upon a suitable accumulator or reel awaiting the practice of the second stage of the first process embodiment illustrated in FIGS. 4 and 5.

Figure 4:
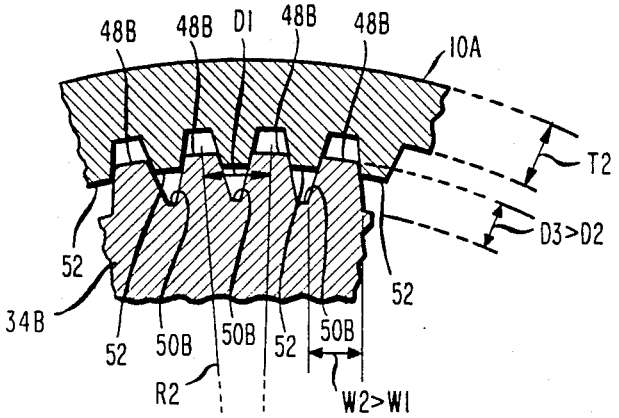
FIGS. 4 and 5 are also such above-noted partial transverse cross-sectional views and illustrate a second stage of the process of the present invention illustrated by FIGS. 2–5 and show in partial transverse cross-sectional view the tubing and a second spinner wherein the height of the spiral fins produced by the first spinner of FIGS. 2 and 3 is increased without further reducing the thickness of the tubing wall.

Referring next to FIG. 4, the tubing 10A is shown whose internal portion 12 has been provided with the plurality of internal spiral fins 52 in the first stage as described above, and also shown in FIG. 4 is a second spinner 34B of generally annular shape and provided around its cylindrical outer surface with a plurality of radially outwardly extending external spiral ridges 48B and a centrally formed aperture (not shown) for mounting the spinner 34B rotatably, for example, on the shaft 36 of an internal forming member or floating plug 38 shown in FIG. 1. The external spiral ridges 48B of the spinner 34B, as shown in FIG. 4, are equal in number to the external spiral ridges 48A provided on spinner 34A (FIG. 2) and are displaced angular distance D1 with respect to each other, the same or substantially the same as the angular displacement D1 of the external spiral ridges 48A of spinner 34A of FIGS. 2 and 3, but the spiral ridges 48B are provided with a wider base width W2 as shown in FIG. 4. The spiral ridges 48B provide a plurality of spiral grooves 50B therebetween having a depth D3 as shown in FIG. 4 greater than the depth D2 of the spiral grooves 50A of the spinner 34A of FIGS. 2 and 3; the spiral grooves 50B, FIG. 4, provide spiral paths therethrough. As will be better understood by the detailed description below, and in accordance with the further teachings of the present invention, the second stage illustrated in FIGS. 4 and 5 of the first process embodiment of the present invention increases the height H1 of the spiral fins 52 without a further reduction in the wall thickness T2 of the tubing 10A, and thus eliminates, or greatly reduces, the possibility of tearing or rupturing the tubing wall (particularly a thin wall) during the process of forming internal spiral fins of sufficient height that they achieve the desired increased or. enhanced thermal transfer between the internally finned or enhanced tubing and a heat transfer fluid flowing therethrough.

Figure 5:
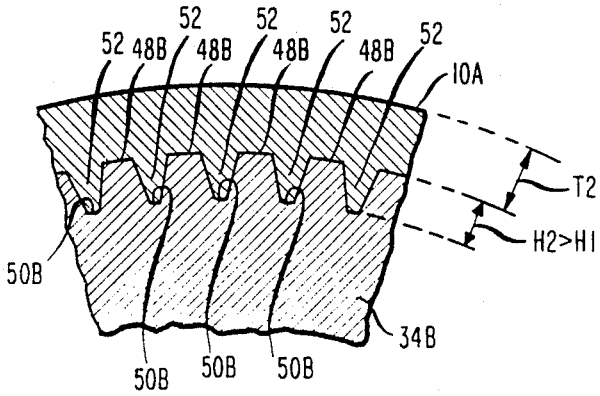

Referring now to FIGS. 1, 4 and 5 and to the second stage of the first process embodiment of the present invention, it will be presumed that the tubing 10A having its internal portion 12 provided with the internal spiral fins 52 by the first stage of the first process embodiment and the spinner 34B occupy the positions shown in FIG. 1, with the tubing 10A provided with the internal spiral fins 52 replacing the tubing 10 shown in FIG. 1 and with the spinner 34A replacing the spinner 34 shown in FIG. 1. As illustrated in FIG. 4, the external spiral ridges 48B provided on the spinner 34B will be aligned with the spiral grooves formed in the internal tubing portion 12 by the external spiral ridges 48A of the spinner 34A in forming the spiral fins 52 as described above with regard to FIGS. 2 and 3.

To maintain the floating plug 38 in place, and to increase the height H1 of the spiral fins 52 without further reducing the wall thickness T2 of the tubing 10A, it will be understood and in accordance with the further teachings of the present invention that the diameters of the conical portion of the passageway extending through the draw die 32, the diameter of the forward conical forward portion of the floating plug 38, and the radius R2 (FIG. 4) and hence the diameter of the spinner 34B are reduced a predetermined percentage of the diameters of the conical forward portion of the passageway extending through the draw die 32, the diameter of the conical forward portion of the floating plug 38 and the radius R1, and hence diameter, of the spinner 34A utilized in the first stage of the first process embodiment of the present invention as described above. In one embodiment, the outer diameter of the tubing 10A is reduced 15% in step two (FIGS. 4 and 5) and accordingly to accomplish this it will be understood that the diameter of the conical forward portion of the passageway extending through the draw die 32, the diameter of the forward conical portion of the floating plug 38, and the radius R2, and hence diameter, of the spinner 34B are reduced to 15% of the corresponding diameters of the conical forward portion of the passageway extending through the draw die 32, the diameter of the conical forward portion of the floating plug 38, and the radius R1, and hence diameter, of the spinner 34A used in the practice of the above-described first stage of the first process embodiment of the present invention (it will be understood, as known to those skilled in the art, that while the forward conical portion of the passageway extending through the draw die 32 and the conical portion of the forward portion of the floating mandrel 38 have a plurality or infinite number of diameters, it is the practice in the art to refer to such diameters collectively as a diameter, and such language is used herein and in the appended claims accordingly) It will now be presumed that such reductions have been made and that the draw blocks 42 (FIG. 1) are engaging the tubing 10A provided with the internal spiral fins 52 and are applying force thereto to advance the tubing 10A in the forward direction indicated by the arrow 44 in FIG. 1.

Tubing 10A will be advanced between opposed conical portions of the draw die 32 and floating plug 38 to further reduce the outer diameter of the tubing 10A, approximately 15% in one embodiment (this reduction in outer diameter maintains the floating plug 38 in place but does not unacceptably iron out or flatten the spiral fins 52) whereafter the tubing 10A is advanced between the straight walled rearward portion of the passageway extending through the draw die and the spinner 34B to cause the external spiral ridges 48B of the spinner 34B (FIGS. 4 and 5) to engage and compress (squeeze inwardly to elongate) the spiral fins 52 (FIG. 4) and cause the spiral fins 52 to flow into the spiral grooves 50B (FIG. 4) and through the spiral paths provided by the spiral grooves 50B and thereby increase the height of the spiral fins 52 from the height H1 shown in FIG. 3 to the height H2 shown in FIG. 5 without further reducing the wall thickness T1 of the tubing 10A.

It will be particularly understood that even though in stage two (FIGS. 4 and 5) the outer diameter of the tubing 10A undergoes a predetermined reduction in percentage of, or with respect to, the outer diameter of the tubing 10A as it exists upon the completion of stage one (FIGS. 2 and 3) (e.g. 15% in one embodiment as described above), the spinner 34B (FIGS. 3 and 4) utilized in stage two does not deepen the grooves formed in the tubing internal portion 12 in forming the fins 52 in the first stage (FIG. 3), and thereby does not further decrease the tubing wall thickness T2 in stage two, because the radius R2, and hence the diameter, of the spinner 34B used in stage two is reduced in radius or diameter the same predetermined percentage of the radius R1 of the spinner 34A used in stage one that the outer diameter of the tubing 10A is reduced in stage two from the outer diameter of the tubing 10A as it exists upon completion of stage one. It will be expressly understood that in stage two, the external spiral ridges 48B formed on the spinner 34B merely engage and compress the spiral fins 52 and cause the spiral fins to flow radially inwardly into the deeper grooves 50B provided between the external spiral ridges 48B and thereby heighten, or increase the height of, the spiral fins to the greater height H2 shown in FIG. 5 without further reducing the wall thickness T2 of the tubing 10A; this permits the forming of internal spiral fins on thin wall tubing without rupturing, tearing or shearing of the thin tube wall.

Reference is now made to the second process embodiment of the present invention for forming internally enhanced tubing, i.e. providing the internal portion of tubing with spiral fins; such process is illustrated in FIGS. 6–9 when taken in conjunction with FIG. 1. Referring first to FIG. 4, tubing 10A is shown having an original wall thickness T1 and including an internal portion 12 into which spiral fins are to be formed. A first spinner 34C is shown which, it will be understood, is of generally annular shape and provided around its cylindrical outer surface with a plurality of radially outwardly extending external spiral ridges 48C and a centrally formed aperture (not shown) for mounting the spinner 34C rotatably, for example, on the shaft 36 of the internal forming member or floating plug 38 shown in FIG. 1; the forward portion of the internal forming member or floating plug 38 is conical as shown in FIG. 1 and is positioned opposite and spaced from the conical forward portion of the passageway extending through the draw die 32. The spinner 34C has a radius R3 and the external spiral ridges 48C are displaced a distance D4 angularly with respect to each other and provide spiral grooves 50C therebetween having a depth D5 and which spiral grooves, it will be understood, provide spiral paths therethrough.

Figure 6:
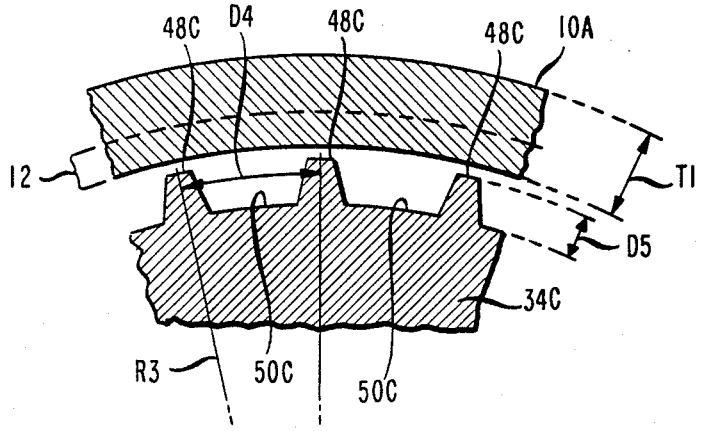
FIGS. 6 and 7 are partial transverse cross-sectional views illustrating a first stage of a second process embodiment of the present invention illustrated in FIGS. 6–9 for providing the internal portion of tubing with spiral fins.
Figure 7:
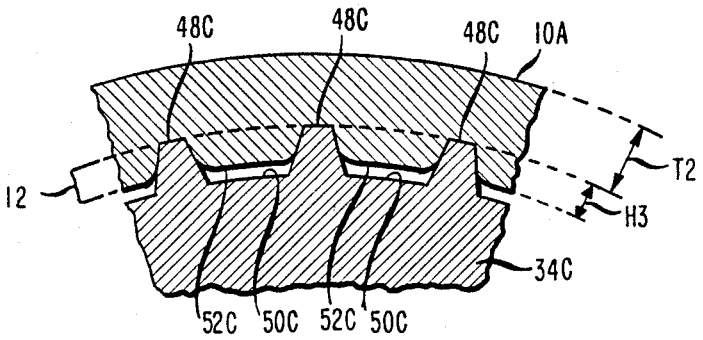

Referring now to FIGS. 1, 6 and 7, and to the first stage of the second process embodiment of the present invention, it will be presumed that the tubing 10A and spinner 34C from FIG. 6 occupy the positions shown in FIG. 1 for tubing 10 and spinner 34 and that the draw blocks 42 (FIG. 1) are engaging the tubing 10A and applying force thereto to move the tubing 10A in the forward direction indicated by the arrow 44. Upon such movement, the tubing will be advanced between the opposed conical portions of the draw die 32 and floating plug 38 to reduce the outer diameter of the tubing 10A, approximately 15% in one embodiment (this reduction in outer diameter maintains the floating plug 38 in place), whereafter the tubing 10A is advanced between the straight walled rearward portion of the passageway extending through the draw die 32 and the spinner 34C to cause the internal portion 12 of the tubing 10A (FIGS. 6 and 7) to engage the external spiral ridges 48C of the spinner 34C and imparts rotation to the spinner and to cause the external spiral ridges 48C of the spinner 34C to engage the tubing internal portion 12 and from grooves therein and cause the tubing internal portion 12 to flow or extend at least partially into the spiral grooves 50C (FIG. 7) and through the spiral paths provided by the grooves 50C and form the plurality of spiral arcuate sections 52C shown in FIG. 3 having a height H1; it will be understood by reference to FIG. 3 that in this first stage of forming the spiral arcuate sections 52C the original wall thickness T1 of the tubing 10A is reduced to a wall thickness T2. This first stage of the process continues until the internal portion 12 of the tubing 10A is provided along its internal length with the plurality of internal spiral arcuate sections 52C whereupon the tubing 10A, for example, may be wound upon a suitable accumulator or reel awaiting the practice of the second stage of the second process embodiment illustrated in FIGS. 8 and 9.

Figure 8:
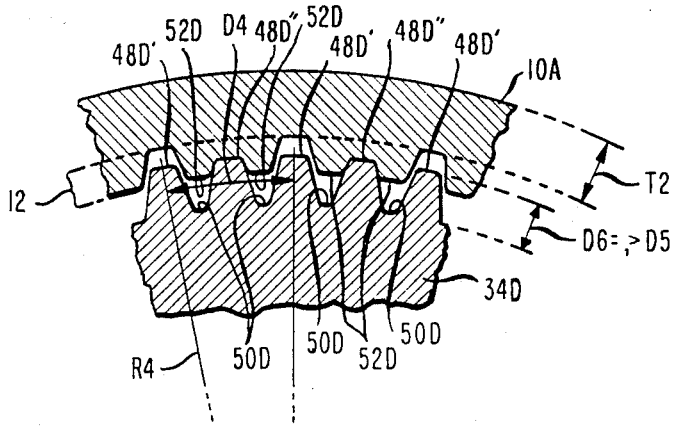
FIGS. 8 and 9 are partial transverse cross-sectional views and illustrate a second stage of the process illustrated in FIGS. 6–9, FIGS. 8 and 9 show tubing and a second spinner for producing internal spiral ridges from the spiral arcuate sections produced by the spinner shown in FIGS. 6 and 7 without further reducing the thickness of the tubing wall.
Figure 9:
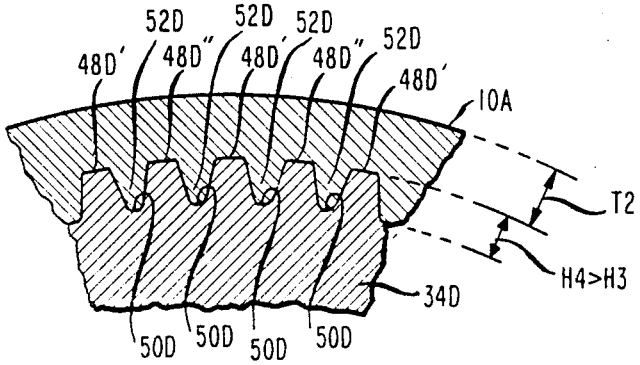

Referring next to FIG. 8, the tubing 10A is shown whose internal portion 12 has been provided with the plurality of internal spiral arcuate sections 52C as described above, and also shown in FIG. 8 is a second spinner 34D of generally annular shape and provided around its cylindrical outer surface with a plurality of radially outwardly extending external spiral ridges 48D' and 48D" and a centrally formed aperture (not shown) for mounting the spinner 34D rotatably, for example, on the shaft 36 of an internal forming member or floating plug 38 shown in FIG. 1. The external spiral ridges 48D' and 48D" of the spinner 34D, as shown in FIG. 9, are equal to twice the number of external spiral ridges 48C provided on spinner 34C (FIG. 6) and the external spiral ridges 48D' are displaced annular distance D4 with respect to each other, the same or substantially the came as the annular displacement D4 of the external spiral ridges 48C of spinner 34C of FIGS. 6 and 7. The spiral ridges 48D' and 48D" provide a plurality of spiral grooves 50D therebetween having a depth D6 as shown in FIG. 8 equal to or greater than the depth D5 of the spiral grooves 50C of the spinner 34C of FIGS. 6 and 7; the spiral grooves 50D, FIG. 8, provide spiral paths therethrough. As will be better understood by the detailed description below, and in accordance with the further teachings of the present invention, the second stage illustrated in FIGS. 8 and 9 of the second process embodiment of the present invention forms the spiral arcute sections 52C of height H3 into spiral fins of greater height H4 (FIG. 9) without a further reduction in the wall thickness T2 of the tubing 10A, and thus eliminates, or greatly reduces, the possibility of tearing or rupturing the tubing wall (particularly a thin wall) during the process of forming internal spiral fins of sufficient height that they achieve the desired increased or enhanced thermal transfer between the internally finned or enhanced tubing and a heat transfer fluid flowing therethrough.

Referring now to FIGS. 1, 8 and 9 and to the second stage of the second process embodiment of the present invention, it will be presumed that the tubing 10A having its internal portion 12 provided with the internal spiral arcuate sections 52C by the first stage of the second process embodiment and the spinner 34D replacing the tubing 10 shown in FIG. 1 and with the spinner 34D replacing the spinner 34 shown in FIG. 1. As illustrated in FIG. 8, the external spiral ridges 48D' provided on the spinner 34D will be aligned with the spiral grooves formed in the internal tubing portion 12 by the external spiral ridges 48C of the spinner 34C in forming the spiral arcuate sections 52D as described above with regard to FIGS. 6 and 7.

To maintain the floating plug 38 in place, and to form the spiral arcuate sections 52C having the height H3 into spiral arcuate fins 52D shown in FIG. 9 having the increased height H4 without further reducing the wall thickness T2 of the tubing 10A, it will be understood and in accordance with the further teachings of the present invention that the diameters of the conical portion of the passageway extending through the draw die 32, the diameter of the forward conical forward portion of the floating plug 38, and the radius R4 (FIG. 8) and hence the diameter of the spinner 34B are reduced a predetermined percentage of the diameters of the conical forward portion of the passageway extending through the draw die 32, the diameter of the conical forward portion of the floating plug 38 and the radius R3, and hence diameter, of the spinner 34C utilized in the first stage of the second process embodiment of the present invention as described above. In one embodiment, the outer diameter of the tubing 10A is reduced 15% in stage two (FIGS. 6 and 7) and accordingly to accomplish this it will be understood that the diameter of the conical forward portion of the passageway extending through the draw die 32, the diameter of the forward conical portion of the floating plug 38, and the radius R4, and hence diameter, of the spinner 34D are reduced to 15% of the corresponding diameters of the conical forward portion of the passageway extending through the draw die 32, the diameter of the conical forward portion of the floating plug 38, and the radius R3, and hence diameter, of the spinner 34 used in the practice of the above-described first stage of the second process embodiment of the present invention (it will be understood, as known to those skilled in the art, that while the forward conical portion of the passageway extending through the draw die 32 and the conical portion of the forward portion of the floating mandrel 38 have a plurality or infinite number of diameters, it is the practice in the art to refer to such diameters collectively as a diameter, and such language is used herein and in the appended claims accordingly). It will now be presumed that such reductions have been made and that the draw blocks 42 (FIG. 1) are engaging the tubing 10A provided with the internal spiral arcuate sections 52C and are applying force thereto to advance the tubing 10A in the forward direction indicated by the arrow 44 in FIG. 1.

Tubing 10A will be advanced between the opposed conical portions of the draw die 32 and floating plug 38 to further reduce the outer diameter of the tubing 10A, approximately 15% in one embodiment (this reduction in outer diameter maintains the floating plug 3 in place but does not unacceptably iron out or flatten the spiral arcuate sections 52C) whereafter the tubing 10A is advanced between the straight walled rearward portion of the passageway extending through the draw die 32 and the spinner 34D to cause the external spiral ridges 48D'' of the spinner 34B (FIG. 8) to engage the spiral arcuate sections 52C and form grooves therein as shown in FIG. 8, and cause portions of the arcuate sections 52C to flow into the spiral grooves 50D (FIG. 8) and through the spiral paths provided by the spiral grooves 50D and thereby form the spiral fins 52D shown in FIG. 8. Thereafter, continued advancement of the tubing 10A in the direction of the arrow 44 of FIG. 1 and continued rotation of the spinner 34D causes the external ridges 48D' and 48D'' of the spinner to compress the spiral fins 52D radially inwardly and cause them to flow into the spiral grooves 50D and through the spiral paths provided by the spiral grooves 50D and thereby increase the height of the spiral fins 52D from the height shown in FIG. 8 to the height H4 shown in FIG. 9 without further reducing the wall thickness T1 of the tubing 10A as is also shown in FIG. 9.

It will be particularly understood that even though in stage two (FIGS. 8 and 9) the outer diameter of the tubing 10A undergoes a predetermined further reduction in percentage of, or with respect to, the outer diameter of the tubing 10A as it exists upon the completion of stage one (FIGS. 6 and 7), e.g. 15% in one embodiment as described above, the spinner 34D (FIGS. 8 and 9) utilized in stage two does not deepen the grooves formed in the tubing internal portion 12 in forming the spiral arcuate sections 52C (FIG. 7) and the grooves formed in the arcuate spiral sections 52C (FIG. 8), and thereby does not further decrease the tubing wall thickness T2 in stage two (FIGS. 8 and 9), because the radius R4 (FIG. 8), and hence the diameter, of the spinner 34B used in stage two is reduced in radius or diameter the same predetermined percentage of the radius R3 of the spinner 34C used in stage one that the outer diameter of the tubing 10A is reduced in stage two from the outer diameter of the tubing 10A as it exists upon completion of stage one. It will be expressly understood that in stage two (FIG. 9), the external spiral ridges 48D' and 48D'' formed on the spinner 34D merely engage and compress the spiral fins 52D (FIG. 8) and cause the spiral fins 52D to flow radially inwardly into the grooves 50D provided between the external spiral ridges 48D' and 48D'' and thereby heighten, or increase the height of, the spiral fins 52D from H3 (FIG. 8) to the greater height H4 shown in FIG. 9 and do not further deepen the grooves formed in the internal portion 12 of the tubing 10A and thereby do not further decrease the wall thickness T2 of the tubing 10A; this permits the forming of internal spiral fins on thin wall tubing without rupturing, tearing or shearing of the thin tube wall.

Figure 11:
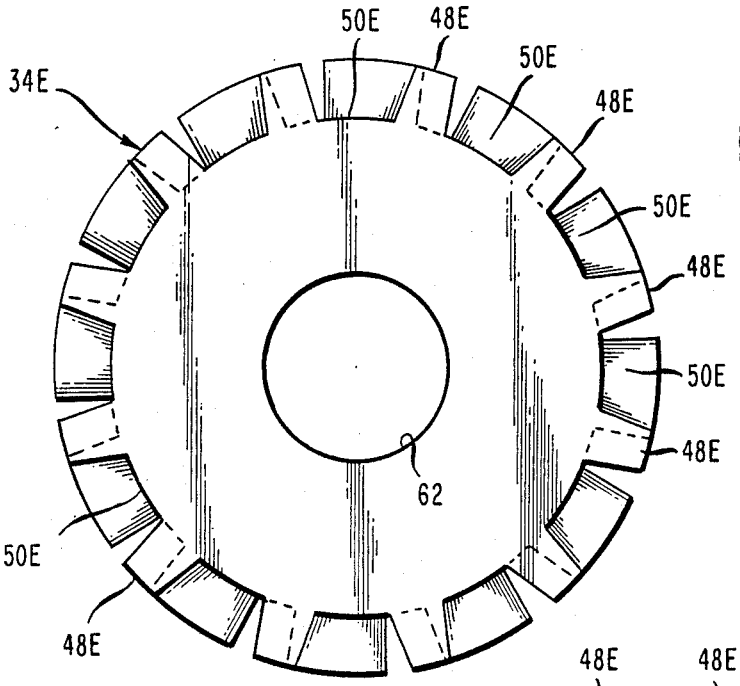
FIGS. 10–12 are, respectively, top, end elevational, and perspective views of a spinner provided with spiral grooves decreasing in width the direction of the spiral path therethrough and which spinner is particularly useful in increasing the height of spiral ridges formed in the internal portion of tubing without further decreasing the tubing wall thickness.
Figure 10:
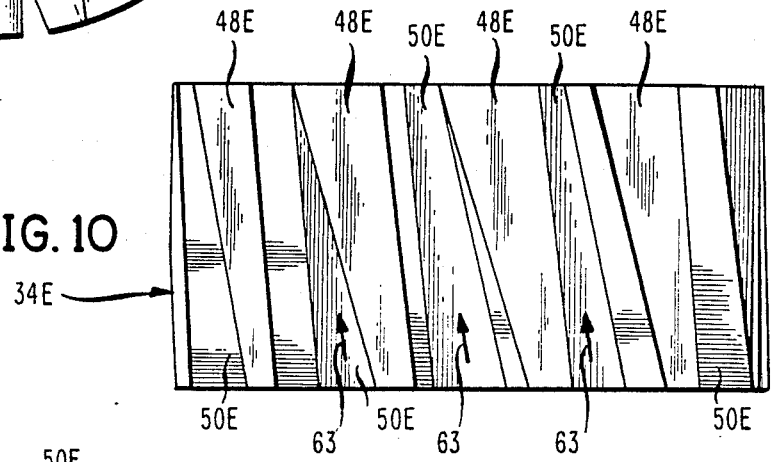
Figure 12:
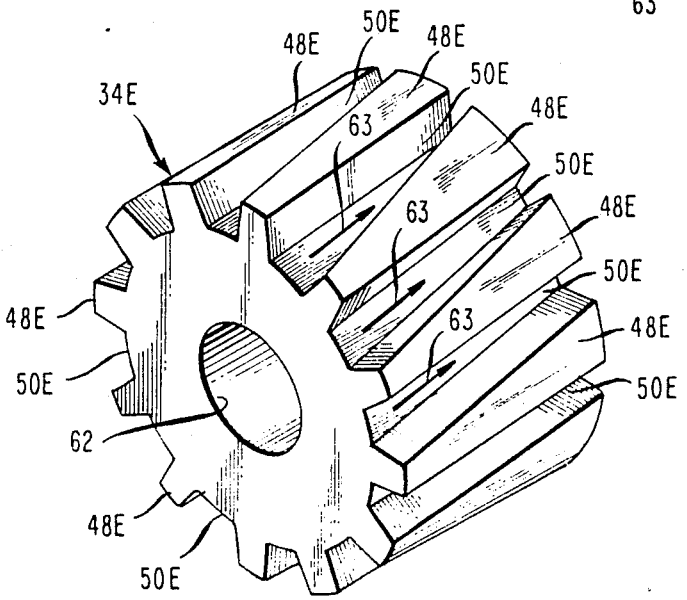

Apparatus according to the present invention for increasing the height of a spiral fin formed on the internal wall of tubing is illustrated in FIGS. 10–12 and embodied in a spinner indicated by general numerical designation 34E shown therein. Spinner 34E is of generally annular shape and is provided around its cylindrical outer surface with a plurality of radially outwardly extending external spiral ridges 48E and a centrally formed aperture 62 for mounting the spinner 34E rotatably, for example, in the shaft 36 of the internal forming member or floating plug 38 shown in FIG. 1. External spiral ridges 48E provide spiral grooves 50E therebetween which grooves provide spiral paths having spiral directions indicated by the arrows 63 shown in FIGS. 10 and 12. It will be understood that arrows 63 indicate the spiral direction of flow of spiral fins, e.g. spiral fins 52, FIG. 3, therethrough upon the external spiral ridges 48E engaging, e.g. spiral fins 52, and compressing such spiral fins radially inwardly and causing such spiral fins to flow into the spiral grooves 50E and through the spiral paths provided thereby to increase the height of such spiral fins. In accordance with still further teachings of the present invention, the width of the spiral grooves 50E may constantly decrease, as may be best seen in FIGS. 10 and 12, in the direction of the spiral paths therethrough indicated by the arrows 63 to enhance the engagement and compression of the spiral fins by the external spiral ridges 48E in causing the spiral fins to increase in height. The spinner 34E (FIGS. 10–12) may be substituted advantageously for the spinner 34B (FIGS. 4 and 5) in the practice of the second stage of the first process embodiment of the present invention. When so substituted, it will be understood that the external spiral ridges 48E of the spinner 34E will be equal in number to, displaced angularly the same distance as, the external spiral ridges 48A of the spinner 38A in practicing the second stage of the first process embodiment of the present invention; also, it will be understood that upon such substitution, the diameter of the spinner 34E is reduced as taught above with regard to spinner 34B and that the depth of the spiral grooves 50E of the spinner 34 will be greater than the depth of the spiral grooves 50A of the spinner 34A.

It will be understood by those skill in the art that many modifications and variations may be made in the present invention without departing from the spirit and the scope thereof.

What is claimed is:

1. Process of forming internally enhanced tubing, comprising the steps of:

forming the internal portion of tubing into a plurality of inwardly extending spiral fins having a first radial length; and lengthening said spiral fins to a second radial length greater than said first radial length.

2. Process of forming internally enhanced tubing, comprising the steps of:

forming the internal portion of tubing into a plurality of inwardly extending spiral fins having a first radial length and providing said tubing with a wall thickness; and lengthening said spiral fins to a second radial length greater than said first radial length without decreasing said wall thickness.

3. Process according to claim 1 or 2 wherein said lengthening step is the step of compressing said spiral fins inwardly to the radial length thereof from said first to said second increase the radial length thereof greater radial length.

4. Process of increasing the height of an internal spiral fin previously formed on tubing having a wall thickness, comprising the steps of:

providing a spinner having at least two external spiral ridges providing a spiral groove therebetween, said spiral groove providing a spiral path having a spiral direction and providing said spiral groove with a width which constantly decreases in the direction of said spiral path and which spiral groove has a uniform depth in the direction of said spiral path; and aligning said external spiral ridges with said previously formed internal spiral fin and producing relative movement between said tubing and said spinner to cause said spiral ridges to engage and compress said spiral fin and cause said spiral fin to flow into said spiral groove and through said spiral path and thereby increase the height of said spiral fin without decreasing said tubing wall thickness.

5. Process of providing the internal portion of tubing with at least one spiral fin, comprising the steps of:

providing a first spinner having at least two first external spiral ridges displaced a predetermined distance angularly with respect to each other and providing a first spiral groove therebetween having a first depth and providing a first spiral path;

producing relative motion between said first spinner and said tubing internal portion to cause said first external spiral ridges to engage said tubing internal portion and form spiral grooves therein and to cause a portion of said tubing internal portion to flow into said first spiral groove and through said first spiral path and form a spiral fin;

providing a second spinner having at least two second external spiral ridges displaced said predetermined distance angularly with respect to each other and providing a second spiral groove therebetween having a second depth greater than said first depth and providing a second spiral path; and aligning said second external spiral ridges of said second spinner with said spiral grooves formed in said tubing internal portion by said first spinner and producing relative movement between said tubing and said second spinner to cause said second external spiral ridges to engage and compress said spiral fin and to cause said spiral fin to flow into said second spiral groove and through said second spiral path and thereby increase the height of said spiral fin.

6. Process of providing the internal portion of tubing with at least one spiral fin, said tubing having an outer wall diameter and a wall thickness, comprising the steps of:

providing a generally annular first draw die having a passageway extending therethrough including a first conical portion and a generally annular first spinner mounted at the end of a first conical portion of a first floating plug, said first spinner having at least two first external spiral ridges having a first base width and displaced a predetermined distance angularly with respect to each other, said two first external spiral ridges providing a first spiral groove therebetween having a first depth and providing a first spiral path;

advancing said tubing between said first conical portion of said first draw die passageway and said first conical portion of said first floating plug and said first spinner to reduce said tubing outer diameter and maintain said first floating plug in place to cause said tubing internal portion to engage and impart rotation to said first spinner and cause said first external spiral ridges form at lest two spiral grooves in said tubing internal portion and cause a portion of said tubing internal portion to flow into said first spiral groove and through said first spiral path and form a spiral fin and provide said tubing with a reduced wall thickness;

providing a second generally annular second draw die having a passageway extending therethrough including a second conical portion and a generally annular second spinner mounted at the end of a second conical portion of a second floating plug, said second spinner having at least two second external spiral ridges having a second base width greater than said first base width and displaced said predetermined distance angularly with respect to each other, said second external spiral ridges providing a second spiral groove therebetween having a second depth greater than said first depth and providing a second spiral path;

said conical portion of said second draw die passageway, said second conical portion of said second floating plug, and said second spinner reduced in diameters a predetermined percentage of the respective diameters of said conical portion of said first draw die passageway, said conical portion of said first floating plug and said first spinner; and aligning said second external spiral ridges of said second spinner with said spiral grooves formed in said tubing internal portion by said first spinner and advancing said tubing between said conical portion of said second draw die passageway and said said second conical portion of said second floating plug and said second spinner to further reduce said tubing outer diameter and maintain said second floating plug in place and to cause said second external spiral ridges to engage and compress aid spiral fin and to cause said spiral fin to flow radially inwardly into said second spiral groove and through said second spiral path and thereby increase the height of said spiral fin without further reducing said tubing wall thickness.

7. Process according to claim 5 or 6 wherein said second spiral path has a spiral direction and wherein said step of providing said second spinner is the further step of providing said second spiral groove with a width which decreases constantly in said spiral direction of said second spiral path to facilitate said increase in height of said spiral fin and which second spiral groove has a uniform depth in said spiral direction of said second spiral path.

8. Process of providing the internal portion of tubing with at least two spiral fins, said tubing having a wall thickness, comprising the steps of:

providing a spinner having at least two first external spiral ridges displaced a predetermined distance angularly with respect to each other and providing a first spiral groove therebetween providing a first spiral path;

producing relative motion between said first spinner and said tubing internal portion to cause said first external spiral ridges to engage said tubing internal portion and form at least two first spiral grooves therein to produce a spiral arcuate section of said tubing internal portion extending between said first external spiral ridges, said arcuate section having a first height;

providing a second spinner having at least two second external spiral ridges displaced said predetermined distance angularly with respect to each other and having at least a third external spiral ridge intermediate said two external spiral ridges, said two second and said third external ridges providing second and third spiral grooves therebetween providing second and third spiral paths; and aligning said two second external ridges of said second spinner with said two first spiral grooves formed in said tubing internal portion by said first spinner and producing relative movement between said tubing and said second spinner to cause said third external spiral ridge to engage said spiral arcuate section and form a third spiral groove therein and to cause portions of said spiral arcuate section to flow into said second and third spiral grooves and through said second and third spiral paths to form said at least two spiral fins, said at least two spiral fins having a second height greater than said first height.

9. Process of providing the internal portion of tubing with at least two spiral fins, said tubing having an outer wall diameter and a wall thickness, comprising the steps of:

providing a generally annular first draw die having a passageway extending therethrough including a first conical portion and a generally annular first spinner mounted at the end of a first conical portion of a first floating plug, said first spinner having at least two first external spiral ridges displaced a predetermined distance angularly with respect to each other, said two first external spiral ridges providing a first spiral groove therebetween having a first depth and providing a first spiral path;

advancing said tubing between said first conical portion of said first draw die passageway and said first conical portion of said first floating plug and said first spinner to reduce said tubing outer diameter and maintain said first floating plug in place to cause said tubing internal portion to engage and impart rotation to said first spinner and cause said first external spiral ridges to form at least two spiral grooves in said tubing internal portion and cause a portion of said tubing internal portion to flow into said first spiral groove and through said first spiral path and form a spiral arcuate section extending at least partially inwardly between said first external spiral ridges and provide said tubing with a reduced wall thickness, said arcuate section having a first height;

providing a second generally annular second draw die having a passageway extending therethrough including a second conical portion and a generally annular second spinner mounted at the end of a second conical portion of a second floating plug, said second spinner having at least two second external spiral ridges displaced said predetermined distance angularly with respect to each other and having at least a third external spiral ridge intermediate said two second external spiral ridges, said two second and said third external spiral ridges providing second and third spiral grooves therebetween having a second depth equal to or greater than said first depth and providing second and third spiral paths;

said conical portion of said second draw die passageway, said second conical portion of said second floating plug, and said second spinner reduced in diameters a predetermined percentage of the respective diameters of said conical portion of said first draw die passageway, said conical portion of said first floating plug and said first spinner; and aligning said two second external spiral ridges of said second spinner with said two spiral grooves formed in said tubing internal portion by said first spinner and advancing said tubing between said conical portion of said second draw die passageway and said said second conical portion of said second floating plug and said second spinner to further reduce said tubing outer diameter said predetermined percentage and to maintain said second floating plug in place and to cause said third external spiral ridge to engage said spiral arcuate section and form a third spiral groove therein and to cause portions of said spiral arcuate section to flow into said second and third spiral grooves and through said second and third spiral paths to form said at least two spiral fins without further reducing said tubing wall thickness, said at least two spiral fins having a second height greater than said first height.

10. Apparatus for increasing the height of a spiral fin previously formed on the internal wall of tubing, comprising:

a spinner having at least two external spiral ridges providing a spiral groove therebetween for receiving said previously formed spiral fin, said spiral groove providing a spiral path having a spiral direction, said spiral groove having a width which constantly decreases in the direction of said spiral path and which spiral groove has a uniform depth in the direction of said spiral path; and upon said spiral fin being aligned with said spiral fin and upon relative movement being produced between said tubing and said spinner said spiral ridges engaging and compressing said spiral fin and causing said spiral fin to flow into said spiral groove and through said spiral path and thereby increase the height of said spiral fin.

* * * * *